US012607118B2

(12) United States Patent
Thomas et al.

(10) Patent No.: US 12,607,118 B2
(45) Date of Patent: Apr. 21, 2026

(54) PRESSURE TEST PLUG

(71) Applicant: Weatherford Technology Holdings, LLC

(72) Inventors: Brennan Thomas, Houston, TX (US); Grant Andrews, Houston, TX (US); Austin Albrecht, Houston, TX (US); Jose Salinas, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/906,193

(22) Filed: Oct. 4, 2024

(65) Prior Publication Data

US 2026/0078672 A1 Mar. 19, 2026

Related U.S. Application Data

(60) Provisional application No. 63/694,873, filed on Sep. 15, 2024.

(51) Int. Cl.
*E21B 49/00* (2006.01)
*E21B 33/128* (2006.01)

(52) U.S. Cl.
CPC ..... *E21B 49/008* (2013.01); *E21B 33/1285* (2013.01)

(58) Field of Classification Search
CPC .... E21B 2200/05; E21B 34/063; E21B 33/12; E21B 34/142; E21B 47/06; E21B 49/008; E21B 34/105; E21B 33/128; E21B 33/1285
See application file for complete search history.

(56) References Cited

U.S. PATENT DOCUMENTS

| | | | | |
|---|---|---|---|---|
| 4,121,660 | A | 10/1978 | Koleilat | |
| 5,542,475 | A | 8/1996 | Turner | |
| 7,159,663 | B2 | 1/2007 | McGuire | |
| 7,516,786 | B2 | 4/2009 | Dallas | |
| 9,334,726 | B2 | 5/2016 | McMiles | |
| 9,410,399 | B2 | 8/2016 | Anderson | |
| 9,470,082 | B1 | 10/2016 | Williams | |
| 9,771,771 | B2 | 9/2017 | Williams | |
| 9,951,576 | B2 | 4/2018 | Bergeron | |
| 10,221,638 | B2 | 3/2019 | Turley | |
| 11,131,163 | B2 | 9/2021 | Lee | |
| 11,365,598 | B2 | 6/2022 | Brandsdal | |
| 2017/0130553 | A1* | 5/2017 | Harris | E21B 33/1291 |
| 2021/0003003 | A1* | 1/2021 | Proett | E21B 47/06 |
| 2023/0167934 | A1 | 6/2023 | Lausch | |
| 2024/0229598 | A1* | 7/2024 | Evans | E21B 34/101 |

FOREIGN PATENT DOCUMENTS

CA 3087196 A1 * 12/2021 ..... E21B 34/063

* cited by examiner

*Primary Examiner* — Zakiya W Bates
(74) *Attorney, Agent, or Firm* — Peter V. Schroeder; Booth Albanesi Schroeder PLLC

(57) ABSTRACT

A pumpable, pressure test plug is provided that has radial fins. The radial fins, which extend from the test plug, allow the plug to be pumped down a subterranean tubular string using a pumping fluid to move the test plug. The test plug is released from a wireline assembly prior to pumping the test plug down the tubular string. A seat is defined downhole in the tubular string to cooperate with a head of the test plug, which seals against the seat positioned in the tubular string.

9 Claims, 3 Drawing Sheets

PRESSURE TEST PLUG

CROSS-REFERENCE TO RELATED APPLICATIONS

Priority claim to U.S. Provisional application 63/694,873 filed Sep. 15, 2024.

TECHNICAL FIELD

This disclosure relates generally to apparatus and methods for plugging a downhole tubular in a subterranean well for running a pressure test, and more specifically, to a releasable, pumpable test plug for use on a wireline string.

BRIEF DESCRIPTION OF THE DRAWINGS

Drawings of the preferred embodiments of the present disclosure are attached hereto so that the embodiments of the present disclosure may be better and more fully understood. The disclosure may be understood by reference to embodiments described herein, some of which are illustrated in the appended drawings. The drawings illustrate only typical embodiments of this disclosure and are therefore not to be considered limiting of the scope of the disclosure.

DETAILED DESCRIPTION OF EMBODIMENTS OF THE DISCLOSURE

It completing an oil and gas production well, it is often necessary to cement a tubular string, such as a casing or liner string, into the wellbore. In the cementing procedure, a wet shoe or float shoe is positioned at the lower end the tubular string for allowing cement to pass through and up the casing annulus between the casing and wellbore. Once cementing is complete, a pressure test is performed to ensure that the cemented tubular string will hold against pressure and has no leaks. After the pressure test, it is common to carry out other completion procedures, such as perforation of the tubular and wellbore, fracturing of the subterranean zone around the wellbore, etc. In many cases, a single work string is run into the tubular string to perform some or all of these tasks in a single trip. One type of work string is a wireline assembly, as is known in the art. On a wireline assembly, a wireline is run into the tubular string. Various tools can be hung from the wireline, such as test plugs, fracturing plugs, bridge plugs, perforating tools, etc. Since the wireline assembly cannot be pushed down the tubular, it is typical to pump the wireline assembly down the hole using a flow of fluid pumped in from the surface.

The isolation plugs can be used to isolate sections of the tubular string. For example, a bridge plug or frac plug can be set in the tubular by radially expanding slips or the like into gripping engagement with the tubular and radially expanding sealing elements into sealing engagement with the tubular. The isolation plugs have moving parts, such as the radially expandable slips and sealing elements, and are commonly set, that is, moved from a run-in position to the set position, using hydraulic pressure in the tubular. Alternately, such isolation plugs can be mechanically set using a setting tool positioned on the wireline assembly. Unfortunately, in some cases these flow obstructing plugs can pre-set, that is, set accidently and early, or get hung up on debris in the tubular. For example, on a wireline assembly composed of tools to allow pressure testing of the cemented tubular string, then isolation of a zone for perforation, then perforation of the tubular string, it is critical that the isolation plugs not set or get hung up prior to pressure testing and proper positioning of the tools.

The disclosure presents a test plug, for use on a wireline assembly, for selectively sealing against fluid flow through the tubular string by sealing against a downhole seat defined in the tubular string for performance of pressure test. The test plug has no moving parts. That is, it does not function by relative movement of various parts of the test plug with relation to each other. Such a test plug prevents early or accidental setting of the plug.

Figure 1:
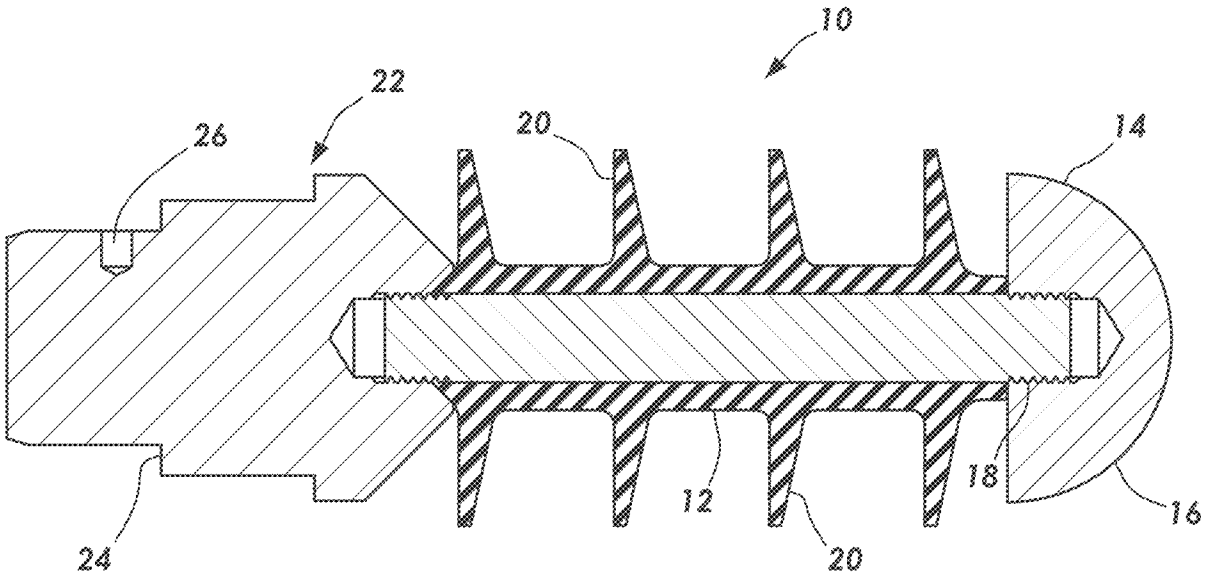
FIG. 1 is a side cross-sectional view of an exemplary test plug according to aspects of the disclosure.

FIG. 1 is a side cross-sectional view of an exemplary test plug according to aspects of the disclosure. Generally, the test plug 10 has a body 12, a head 14 at its downhole or lower end, and at its uphole or upper end a connection 22 for releasably attaching the test plug to a wireline assembly.

The head 14 of the test plug defines a sealing surface 16 for sealing cooperation with a seat defined in the tubular string. For example, a seat can be defined in a wet shoe sub at or near the bottom of the tubular string. The head 14 is illustrated as semi-spherical but can take other shapes as is known in the art, such as conical, semi-conical and the like.

The body 12 is attached to the head 14 at threaded connection 18 in the embodiment shown. Alternately, the body and head can be formed monolithically. The body can be of any suitable material, metal, composite, plastic, etc.

A plurality of radial fins 20 are positioned on or extend from the test plug body 12. The fins can be attached to the plug body 12 individually, as a fin stack as shown, or formed monolithically with the body. The fins extend radially across the interior bore of the tubular string. The fins 20 function to allow the test plug to be pumped down the tubular string by pumping fluid from the surface into the string. The fins can be used to pump down the wireline assembly, with the force of the pumping fluid pushing the test plug, which in turn pulls the wireline assembly above the test plug. When the test plug is released from the wireline assembly, the fins function to allow the test plug to be pumped into position against a seat defined in the tubular string. The fins can be made of rubber, plastic, or other materials as are known in the art.

The connection 22 is shown as having shoulders 24 suitable for cooperating with a housing of a releasing tool, and with a shear pin hole 26 for receiving a shear pin. Other connection types are known in the art.

Figure 2:
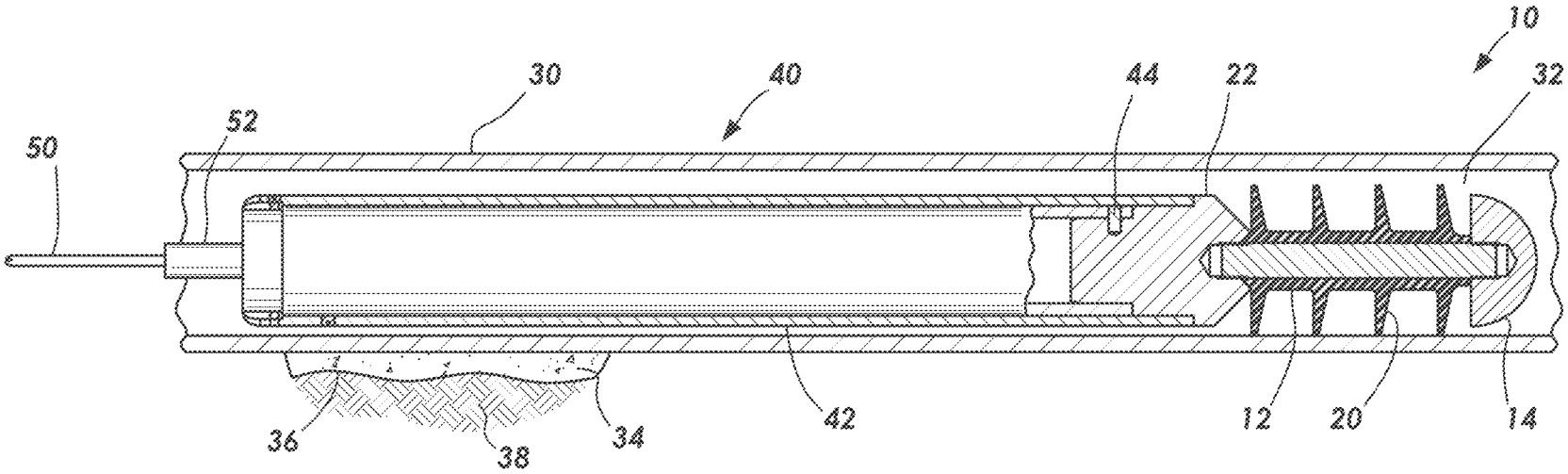
FIG. 2 is a partial cross-sectional side view of an exemplary wireline assembly including a test plug according to aspects of the disclosure.

FIG. 2 is a partial cross-sectional side view of an exemplary wireline assembly including a test plug according to aspects of the disclosure. A tubular string 30 extends through a subterranean zone 38 of a formation. A central bore 32 is defined by the tubular string. The tubular string 30 is comprised of multiple tubulars connected together, as is known in the art. The tubular string can be a casing string, a liner string, or other generally tubular string. The tubular string 30 is cemented 34 into the wellbore 36. The tubular string and wellbore can be vertical, horizontal or any other orientation, as is known in the art.

A wireline assembly 40 is seen positioned in the tubular string 30. The assembly shown includes a test plug 10 releasably attached at connection 22 to a release assembly 42. The connection 22 shown utilizes shear pins 44 which cooperate with the shear pin holes 26 defined in the connection. Those of skill in the art will recognize other types of releasable connections which can be used alternatively. The release assembly 42 is attached to the test plug during run-in, until it is desired to release the test plug from the wireline assembly. The release assembly then releases the test plug at connection 22. Release assemblies are known in the art. Exemplary release assemblies are commercially available, such as the Baker (tradename) #10 setting tool and Weatherford (tradename) Hydraulic Setting Tool. The release assembly 42 can be signaled or operated to release the test plug by electrical signal through the wireline or as is known otherwise in the art. The release assembly 42 is attached to the wireline 50 at connection 52.

Figure 3:
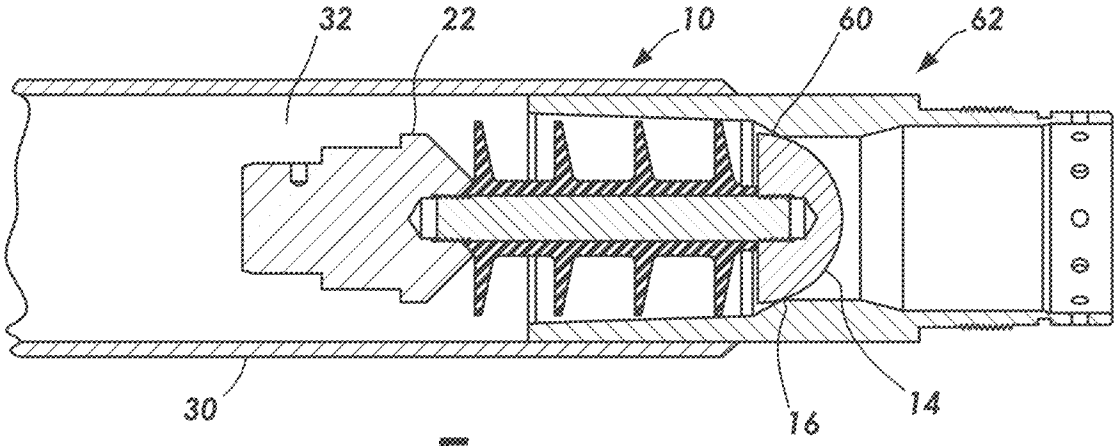
FIG. 3 is a cross-sectional side view of a test plug according to aspects of the disclosure, released from the wireline assembly and seated on a seat defined in the tubular string.

FIG. 3 is a cross-sectional side view of a test plug according to aspects of the disclosure, released from the wireline assembly and seated on a seat defined in the tubular string. The tubular string 30 has, at its lower end, a seat 60 defined in the tubular string. In the drawing, the tubular string 30 includes a wet shoe sub 62 at its lower end. As those of skill in the art understand, the seat can alternately be defined in a float shoe, float collar, or other tubular string member.

The head 14 of the test plug, at sealing surface 16 seals in cooperation with seat 60 to block fluid flow through the tubular string and wet shoe sub 62. The upper end of the test plug has been released from the wireline assembly 40 at connection 22. The test plug is now in position for performance of a pressure test.

Figure 4:
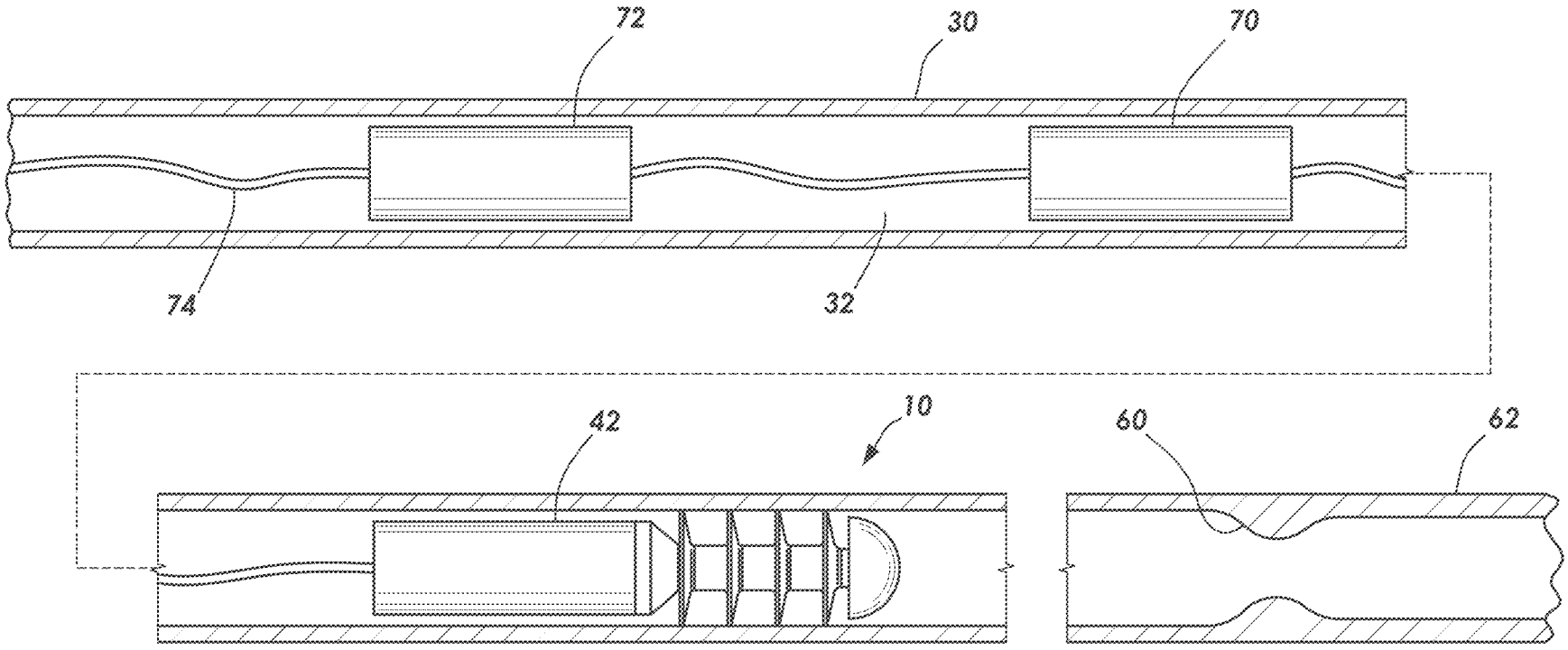
FIG. 4 is a schematic of an exemplary wireline assembly for use with the test plug according to aspects of the disclosure.

FIG. 4 is a schematic of an exemplary wireline assembly for use with the test plug according to aspects of the disclosure. The wireline assembly 40 is positioned in the tubular string 30 and includes the test plug 10, a release assembly 42, an isolation plug 70, a perforating tool assembly 72, connected by wirelines 74. The schematic is exemplary in nature and not to scale. The wireline assembly can include various tool assemblies, including various isolation plug assemblies, setting assemblies, perforation tool assemblies and the like as is known in the art.

In use, the test plug 10 is attached to the lower end of a wireline assembly 40. The wireline assembly is run into the tubular string 30 such as by pumping the assembly down the hole. The fins 20 of the test plug 10 can be used to pump down, or assist in pumping down, the wireline assembly. A pumping fluid is pumped into the tubular string from the surface. The fluid acts against the fins and forces the test plug downhole. Once the test plug 10 is positioned at a selected location a distance above the seat 60, for example, as defined in the wet shoe sub 62, the release assembly 42 is activated and releases the test plug 10 from the wireline assembly.

After being released, the test plug is pumped down the tubular assembly until it sealingly seats against the seat 60 (as seen in FIG. 3). A pumping fluid, pumped from the uphole, acts on the radial fins 20 of the test plug 10, thereby moving the test plug into a seated position on the seat 60. The sealing surface 16 of the head 14 of the test plug 10 seats against and seals with the cooperating seat 60 defined in the tubular string. Here, the seat 60 is defined in an exemplary wet shoe sub 62 positioned at the lower end of the tubular string.

A pressure test is performed by pressuring up the interior bore of the tubular string. The pressure is held by the test plug 10 seated against the seat 60. If the pressure test is successful, subsequent procedures can be carried out using the wireline assembly 40. For example, one or more isolation plugs, such as frac plugs, bridge plugs and the like, can be set in the tubular string. Isolation plug 70, for example, can be set, as is known in the art, by radially expanding slips or the like into gripping engagement with the tubular string. Once the isolation plug is set, further procedures can be performed. For example, a perforation assembly 72 can be activated to perforate the tubular string 30.

In some cases, the wireline assembly 40 is pumped down the tubular string 30 until the test plug 10 contacts the seat 60 of the wet shoe sub 62. Then the wireline assembly is pulled back up the tubular string a selected distance above or uphole from the seat 60. Then the test plug 10 is released from the wireline assembly 40 by activating the release assembly 42. The test plug 10 is then pumped down the tubular string by pumped fluid acting on the radial fins 20 of the test plug 10. In some cases, the distance and pump rates are selected to give the test plug 10 enough momentum to solidly seat and seal against the seat 60. Once the test plug 10 is in sealing, seated position on the seat 60, as seen in FIG. 3, additional procedures can take place. In some cases, a pressure test is performed to determine the integrity of the tubular string by increasing hydraulic pressure in the string. Thereafter, in some embodiments, additional procedures are undertaken. For example, an isolation plug assembly 70 is set into gripping engagement with the tubular string and/or a perforation assembly 72 is activated to perforate the tubular string.

The embodiments disclosed above are illustrative only, as the present disclosure may be modified and practiced in different but equivalent manners apparent to those skilled in the art having the benefit of the teachings herein. It is therefore evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims. Section headings are for reference only and are non-limiting.

The invention claimed is:

1. A method of running a pressure test in a tubular string extending through a subterranean zone, the method comprising:

pumping down a wireline assembly through the tubular string; then releasing a test plug from the wireline assembly a selected distance uphole from a seat defined in the tubular string; then pumping the released test plug down the tubular string, a pumping fluid acting on one or more radial fins extending from a body of the test plug; then seating a sealing face of the test plug on the seat; and then pressure testing the tubular string, wherein a pressure is held by the test plug seated against the seat.

2. The method of claim 1, wherein releasing the test plug further comprises activating a release assembly of the wireline assembly.

3. The method of claim 1, further including, after seating the test plug on the seat, increasing fluid pressure in the tubular string above the test plug.

4. The method of claim 3, wherein the seat is defined in a wet shoe assembly.

5. The method of claim 1, further comprising, before releasing the test plug, pumping down the wireline assembly and contacting the seat with the test plug, then pulling the wireline assembly uphole to the selected distance uphole from the seat.

6. The method of claim 1, further comprising, after pressure testing the tubular string, setting an isolation plug of the wireline assembly in the tubular string uphole from the test plug.

7. The method of claim 6, further comprising, after pressure testing the tubular string, perforating the tubular string with a perforating assembly of the wireline assembly.

8. The method of claim 1, wherein the tubular string comprises a casing string or a liner string.

9. The method of claim 1, wherein the one or more radial fins are a plurality of radial fins or a fin stack.

* * * * *